US010429138B2

(12) United States Patent
Gissen et al.

(10) Patent No.: US 10,429,138 B2
(45) Date of Patent: Oct. 1, 2019

(54) METHODS AND APPARATUS TO GENERATE OSCILLATING FLUID FLOWS IN HEAT EXCHANGERS

(71) Applicant: The Boeing Company, Chicago, IL (US)

(72) Inventors: Abraham Naroll Gissen, Brentwood, MO (US); Rene Woszidlo, St. Charles, MO (US)

(73) Assignee: THE BOEING COMPANY, Chicago, IL (US)

( * ) Notice: Subject to any disclaimer, the term of this patent is extended or adjusted under 35 U.S.C. 154(b) by 377 days.

(21) Appl. No.: 15/242,937

(22) Filed: Aug. 22, 2016

(65) Prior Publication Data

US 2018/0051943 A1 Feb. 22, 2018

(51) Int. Cl.

| | |
|---|---|
| ***F28F 13/06*** | (2006.01) |
| ***F28F 13/12*** | (2006.01) |
| ***F28F 13/08*** | (2006.01) |
| ***F28F 3/02*** | (2006.01) |

(52) U.S. Cl.

CPC ..... *F28F 13/06* (2013.01); *F28F 3/02* (2013.01); *F28F 13/08* (2013.01); *F28F 13/12* (2013.01); *F28F 2210/02* (2013.01); *F28F 2215/04* (2013.01)

(58) Field of Classification Search

CPC .. F28F 13/06; F28F 13/08; F28F 13/12; F28F 3/02; F28F 2215/10; F28F 2215/06; F28F 2215/02; H01L 23/367; H01L 23/3672

USPC ..... 165/109.1

See application file for complete search history.

(56) References Cited

U.S. PATENT DOCUMENTS

| | | | | |
|---|---|---|---|---|
| 5,801,442 | A | 9/1998 | Hamilton et al. | |
| 5,906,317 | A * | 5/1999 | Srinath | B05B 1/08 239/284.1 |
| 6,253,782 | B1 * | 7/2001 | Raghu | B05B 1/08 137/14 |
| 7,128,082 | B1 * | 10/2006 | Cerretelli | B05B 1/08 137/14 |
| 8,336,828 | B2 | 12/2012 | Shmilovich | |
| 8,517,108 | B2 | 8/2013 | Schultz et al. | |
| 9,333,517 | B2 * | 5/2016 | Koklu | B05B 1/08 |
| 2005/0081552 | A1 | 4/2005 | Nilson et al. | |

(Continued)

FOREIGN PATENT DOCUMENTS

| | | | |
|---|---|---|---|
| GB | 1356114 A * | 6/1974 | F28F 13/02 |
| WO | 9967539 | 12/1999 | |

OTHER PUBLICATIONS

Lee et al., "Experimental Investigation of Oblique Finned Microchannel Heat Sink," 2010, IEEE, 7 pages.

(Continued)

*Primary Examiner* — Tho V Duong

(74) *Attorney, Agent, or Firm* — Hanley, Flight & Zimmerman, LLC

(57) ABSTRACT

Methods and apparatus to generate oscillating fluid flows in heat exchangers are disclosed. A disclosed fluid flow apparatus includes a repeating pattern of fins arranged in rows, where fins of each row are separated from one another by channels, where the fins have respective sub-channels extending therethrough to facilitate oscillation of fluid moving through the channels, and where each of the sub-channels defines a sub-channel inlet and a sub-channel outlet of a respective fin of the pattern.

15 Claims, 8 Drawing Sheets

(56) References Cited

U.S. PATENT DOCUMENTS

| | | | | |
|---|---|---|---|---|
| 2010/0091459 | A1 | 4/2010 | Zhang | |
| 2011/0139429 | A1* | 6/2011 | Salapakkam | H01L 23/467 165/185 |
| 2013/0277502 | A1 | 10/2013 | Bauer et al. | |
| 2014/0216696 | A1* | 8/2014 | Donnelly | H01L 23/467 165/121 |
| 2014/0284430 | A1 | 9/2014 | Seifert et al. | |

OTHER PUBLICATIONS

Lee et al., "Enhanced Thermal Transport in Microchannel Using Oblique Fins," vol. 134, Oct. 2012, ASME, 10 pages.
Pack et al., "Overview of Active Flow Control at NASA Langley Research Center," 12 pages.
Vatsa et al., "Numerical Simulation of Fluidic Actuators for Flow Control Applications," American Institute of Aeronautics and Astronautics Paper 2010-4001, 17 pages.
Shearer et al. "Some Analytical and Experimental Studies of Laminar Proportional Amplifiers," Apr. 1976, U.S. Army Material Development and Readiness Command, Harry Diamond Laboratories, 54 pages.
Joyce, "Design Guide for Fluidic Laminar Proportional Amplifiers and Laminar Jet Angular Rate Sensors," Sep. 1984, U.S. Army Electronics Research and Development Command, 81 pages.
NASA, "Flow Control Devices," 2 pages.
Yu et al., "Single-Phase Modeling in Microchannel with Piranha Pin Fin," Excerpt from Proceedings of the 2015 COMSOL Conference in Boston, 5 pages.

* cited by examiner $T_0$ $T_{0+\delta}$ $T_{0+2\delta}$

METHODS AND APPARATUS TO GENERATE OSCILLATING FLUID FLOWS IN HEAT EXCHANGERS

FIELD OF THE DISCLOSURE

This disclosure relates generally to heat exchangers and, more particularly, to methods and apparatus to generate oscillating fluid flows in heat exchangers.

BACKGROUND

Heat exchange devices such as channel fin arrays are used in many known applications for convectional heat transfer. In particular, an array may be used to increase an amount of surface area in contact with fluid moving through an array, thereby more efficiently transferring heat between the fluid and the array. In some typical examples, an array of fins may be used to transfer heat between a first flowing fluid to a second flowing fluid that is moving in a different direction from the first flowing fluid (e.g., a countercurrent heat exchanger, etc.).

A fin array may have a performance tradeoff among pressure drop, heat flux, and turbulence related to mixing fluid flow moving therethrough. Because these factors may affect thermal performance significantly, parameters such as fin array patterning, pressure drop, fin geometry, and/or spacing are often determined in an ad hoc empirical manner (e.g., trial and error, experimental data and/or use of data tables) to provide a desired or required convectional heat transfer rate (e.g., above a threshold heat flux value). For example, determining parameters including, but not limited to, pressure drop, fin array geometry, and/or spacing of the fin array pattern can be used to ensure a sufficient convectional (i.e., convective) heat transfer rate. As a result, such relatively specific heat exchanger designs may require significant experimentation, adjustment, and/or design efforts to attain the desired or required convectional rate.

SUMMARY

An example fluid flow apparatus includes a repeating pattern of fins arranged in rows, where fins of each row are separated from one another by channels, where the fins have respective sub-channels extending therethrough to facilitate oscillation of fluid moving through the channels, and where each of the sub-channels defines a sub-channel inlet and a sub-channel outlet of a respective fin of the pattern.

Another example fluid flow apparatus includes a pattern of fins that extend parallel to one another and arranged along a width of a fluid flow channel, and where each of the fins has a leading edge. The example apparatus also includes a pattern of sweep jets arranged upstream of the leading edges of the fins to generate an oscillatory fluid flow through the fins, where the sweep jets are spaced apart from one another along the width of the fluid flow channel.

Another example fluid flow apparatus includes a pattern of fins arranged in rows, where each of the fins extends along a longitudinal direction, and where each fin of the fins includes an incurvate surface on a downstream side of the fin to generate an oscillatory fluid flow that moves past the fins.

An example method for assembling a fluid flow apparatus includes coupling a tessellated pattern of fins in staggered rows, where the fins are identical in shape to one another and oriented along a same direction, where a fin of the pattern of fins with at least one incurvate surface is to generate an oscillating fluid flow relative to the fin when fluid flows across the fin.

An example method for operating a fluid flow apparatus, which includes a substrate and fins, includes directing a fluid towards the fins, where the fins include a sub-channel, and transferring heat between the fins and the fluid as the fluid flows into the sub-channel to define an oscillating fluid flow that increases surface wetting between the fins and the fluid.

An example apparatus includes means for generating a recirculating fluid flow across a tessellated pattern of fins arranged in rows, where the means for generating the recirculating flow has flow direction oscillation means.

Figure 1:
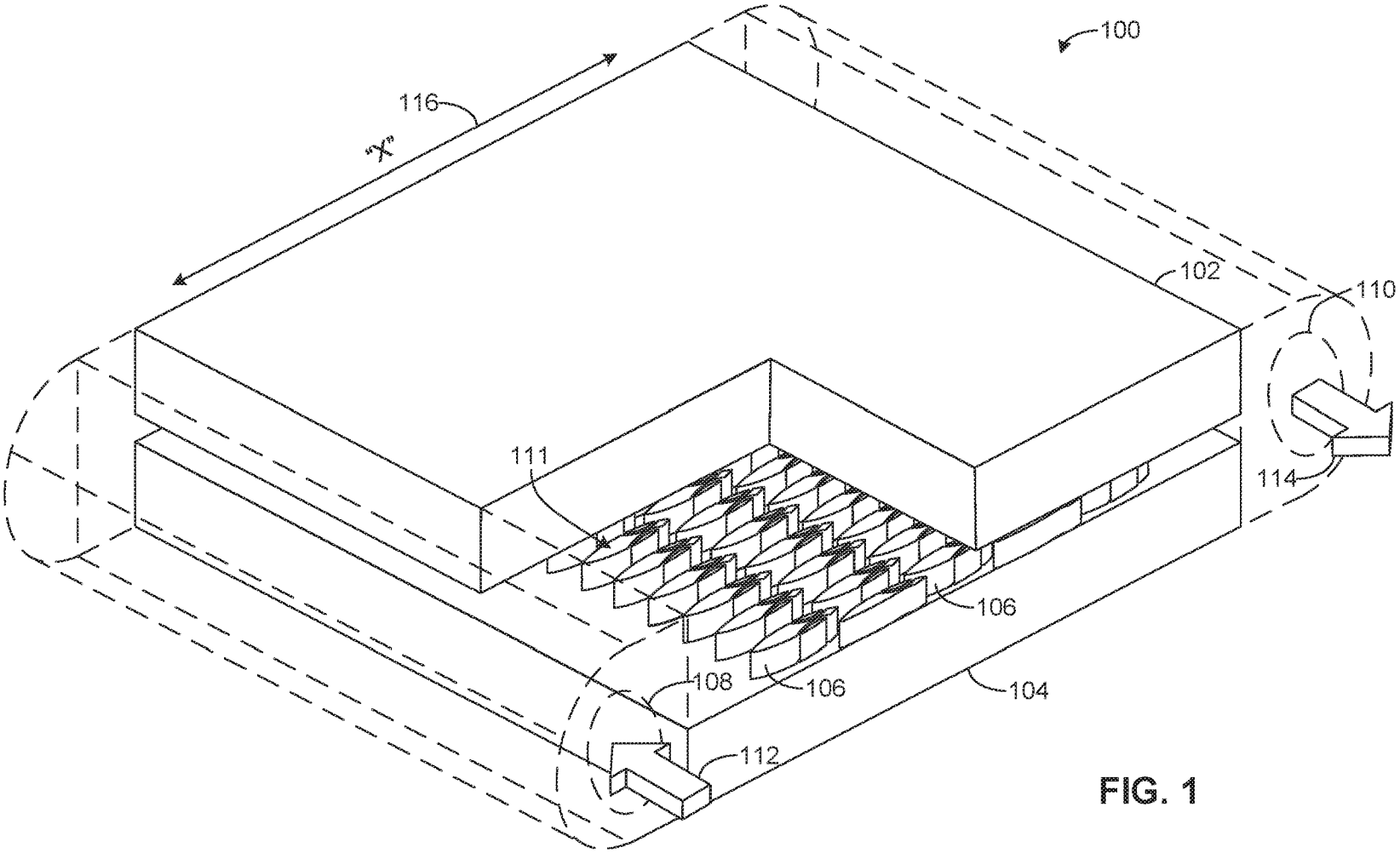
FIG. 1 is an isometric partially cross-sectioned view of an example oscillating fluid flow apparatus in accordance with the teachings of this disclosure.

The figures are not to scale. Instead, to clarify multiple layers and regions, the thickness of the layers may be enlarged in the drawings. Wherever possible, the same reference numbers will be used throughout the drawing(s) and accompanying written description to refer to the same or like parts. As used in this patent, stating that any part is in any way positioned on (e.g., positioned on, located on, disposed on, or formed on, etc.) another part, means that the referenced part is either in contact with the other part, or that the referenced part is above the other part with one or more intermediate part(s) located therebetween. Stating that any part is in contact with another part means that there is no intermediate part between the two parts.

DETAILED DESCRIPTION

Methods and apparatus to generate oscillating fluid flows are disclosed herein. The examples disclosed herein do not generally require precise determinations of these parameters because of their relatively high thermal efficiency. Further, the examples disclosed herein are greatly adjustable (e.g., adjustable heat flux) and, thus, a single design may be adaptable to a wide variety of applications without significant redesign, for example.

To improve thermal efficiency such that an increased amount of heat is transferred per unit volume of mass flowing, the examples disclosed herein generate oscillating fluid flows through a fin array (e.g., a microchannel fin array, a macro scale fin array, etc.), thereby generating an instability of the fluid flows to effectively increase an amount of convective heat transfer due to increased surface wetting. The examples disclosed herein generate the oscillations without moving parts (e.g., moving flaps, actuators, etc.). In particular, the examples disclosed herein utilize tessellation patterns and/or arcuate curves, for example, to generate oscillations in the fluid flows, thereby increasing a heat flux through the fin array.

In some examples, sub-channels disposed in fins are used to generate the oscillating fluid flows. In such examples, the fins are provided with the sub-channels to facilitate an oscillating motion of fluid moving past rows of the fins, thereby increasing a heat transfer rate of the fluid. In some examples, a pattern (e.g., a row, an array, etc.) of sweep jets are used to enable oscillating motions on a fin array. In some examples, a pattern of fins with incurvate cuts and/or surfaces may be used to effectively generate an oscillating fluid flow.

As used herein, the terms "fin" or "fins" may refer to heat sinks, heat exchange surfaces, heat transfer surfaces, protrusions, indentations, and/or curves, etc. that may be used to increase a surface area of material in contact with a flowing fluid. While some of the examples disclosed herein are shown in microchannels and/or a microchannel scale (e.g., smaller than or on the order of a millimeter), the examples disclosed herein may be applied to any appropriate scale (e.g., on the order of several centimeters (cm), meters, several feet, etc.). As used herein, the terms "heat exchanger" or "heat exchanger fins" may refer to a heat exchanger with countercurrent and/or cross flows, or a cooling device operatively coupled to a heat generating device, for example.

While the examples disclosed herein are generally directed towards using a fluid to remove heat from a component and/or crossflowing fluid, the examples disclosed herein may be used to provide heat to the component and/or the crossflowing fluid (e.g., utilizing the fluid to provide heat via fins). While the examples shown are generally shown along two dimensions for clarity, any of the examples disclosed herein may be applied to three-dimensional structures (e.g., channels that at least partially extend along directions into the views shown).

FIG. 1 is an isometric partially cross-sectioned view of an example oscillating fluid flow apparatus 100 in accordance with the teachings of this disclosure. The oscillating fluid flow apparatus 100 of the illustrated example includes a substrate (e.g., a power generating electrical component, an interface block, a heat transfer surface, etc.) 102, a plate 104, and fins (e.g., channel fins, microchannel fins, heat sinks, etc.) 106. In this example, the substrate 102 has an opening/inlet 108 to define a fluid inlet and an opening 110 to define a fluid outlet. The fins 106 are arranged in an array 111 that can be referred to as a fin array, fin pattern array and/or a heat sink array. In some examples, the fluid flow apparatus 100 may function as a heat exchanger where a first fluid flows past the substrate 102 and a second fluid flows past the plate 104 (e.g., along the fins 106).

To facilitate heat transfer between a fluid and the substrate 102 and/or a component coupled to the substrate 102, the fluid of the illustrated example flows into the inlet 108 in a direction generally indicated by an arrow 112. The fluid then flows past the fins 106, thereby removing heat from the fins 106 that has been generated by the substrate 102. As will be discussed in greater detail below in connection with FIGS. 2 and 3A-3C, the fins 106 of the illustrated example have a geometry or shape (e.g., a non-moving/stationary oscillation device) to induce oscillating fluid flows and/or pulsating flows of the fluid past the fins 106 towards the opening 110, through which the fluid exits the flow system 100 in a direction generally indicated by an arrow 114.

In this example, the oscillating fluid flow system 100 has a characteristic dimension 116 defined by a distance between the opening 108 and the opening 110, which is denoted by "X." In this example, the characteristic dimension 116 is approximately 10-20 cm. However, any appropriate dimension(s) and/or relative dimensional scale(s) may be used to suit the needs of a particular application and/or desired use.

Figure 2:
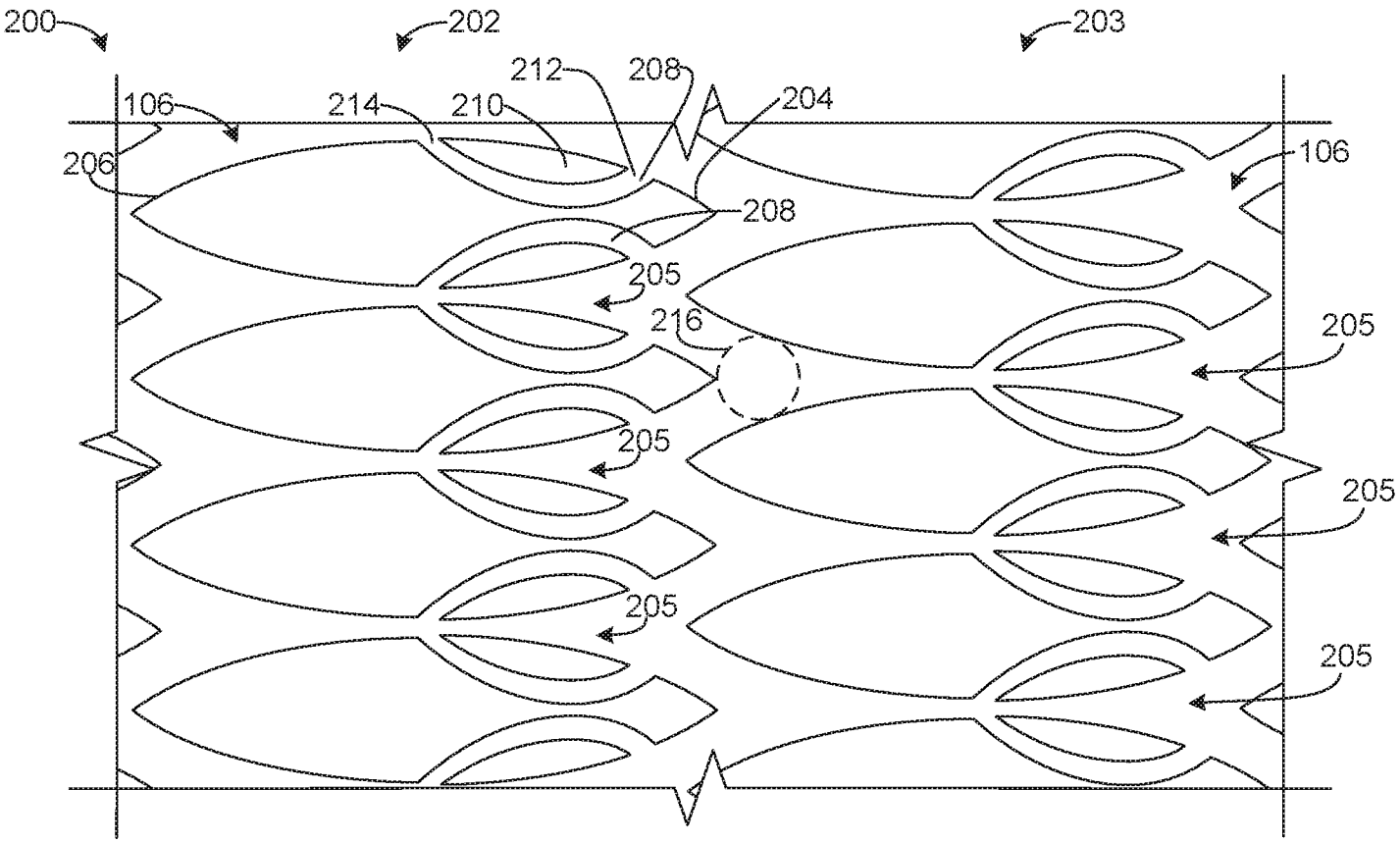
FIG. 2 is a detailed view of an example tessellated pattern of heat exchanger fins of the example oscillating fluid flow apparatus of FIG. 1.

FIG. 2 is a detailed view of an example tessellated pattern 200 of the example fins 106 of the example oscillating fluid flow apparatus 100 described above in connection with FIG. 1. In the view of FIG. 2, a repeating pattern (e.g., a staggered repeating pattern, tiling or repeating of a block pattern of the fins 106, etc.) of fins 106 is shown with a first row 202 of the fins 106 on a left side of FIG. 2 and a second row 203 of the fins 106, which is staggered in a vertical direction relative to the first row 202. In particular, the fins 106 of the rows 202, 203 of the illustrated example are staggered by approximately a half pitch distance between the rows 202, 203. However, the rows 202, 203 may be staggered to any appropriate degree (e.g., not staggered, staggered by one-third of a pitch, etc.) based on application and/or heat flux requirements, for example. According to the illustrated example, along each row, each of the fins 106 is separated by a respective fin of the same row via a channel 205.

The fins 106 of the illustrated example have oblong ellipsoid shapes. In particular, each of the fins 106 includes a trailing edge (e.g., a trailing edge portion, a trailing edge side) 204 and a leading edge (e.g., a leading edge portion) 206, both of which are labeled in relation to a direction of fluid flow in this example. However, in some examples, the trailing edge 204 and the leading edge 206 may be reversed (i.e., a reverse flow) while the fins 106 still facilitate generation of an oscillating flow of a fluid flowing therethrough.

To facilitate an oscillating fluid flow, each of the fins 106 of the illustrated example includes sub-channels (e.g., scallop cuts, incurvate cuts, etc.) 208. In this example, each of the sub-channels 208 defines an arcuate portion (e.g., an incurvate portion) 210 of the fin 106. As will be shown in greater detail below in connection with FIGS. 3A-3C, each of the sub-channels 208 defines a sub-channel inlet 212 and a sub-channel outlet 214, which is located near a middle portion of the respective fin 106. The sub-channels 208 are to recirculate a portion of the fluid, thereby directing the fluid moving past the fins 106 to oscillate (e.g., periodically oscillate) upward and downward in the view of FIG. 2 into a row transition region 216 of the channel 205. In particular, the sub-channels 208 of the illustrated example have a curvature that sweeps downward from the trailing edge 204 and upwards toward the middle portion of the respective fin 106. In this example, the sub-channels 208 are opposing (e.g., on top and bottom ends) of the respective fin 106, where each sub-channel 208 is shaped to have the inlet 212 and the outlet 214 positioned so that a flow of fluid between the fins 106 causes a backflow through one of the sub-channels 208. This resulting backflow, which is a fluid flow in a direction generally opposed or opposite a primary fluid flow, then causes a disturbance in the primary fluid flow that results in a re-direction of the primary flow that causes a backflow of fluid through an opposing sub-channel 208 in the other fin 106 adjacent to the channel 205 between the fins 106. The backflow through the opposing sub-channel 208 then causes a similar disturbance and redirection of the primary fluid flow that results in a backflow again through the other sub-channel 208. This process then repeats or cycles as long as the primary flow of fluid is maintained.

Additionally or alternatively, any of the sub-channel inlets 212, the sub-channel outlets 214 and/or the sub-channels 208, in general, may be located proximate the leading edge 206. In some examples, the sub-channels 208 have a partial depth (e.g., the sub-channels 208 do not extend to the plate 104). Additionally or alternatively, the sub-channels 208 may have a varying depth (i.e., into the view of FIG. 2) across respective lengths of the sub-channels 208. In some examples, inserts may and/or plugs may be placed into the sub-channels 208 to adjust fluid flow and/or heat transfer capabilities of the example pattern 200. While the opposing sub-channels 208 of each respective fin 106 are generally identical in this example, the opposing sub-channels 208 may vary for each respective fin 106 by length and/or curvature. While the example fins 106 each have relatively sharp distal ends, in some examples, the fins 106 may have blunt and/or rounded ends instead.

Figure 3A:
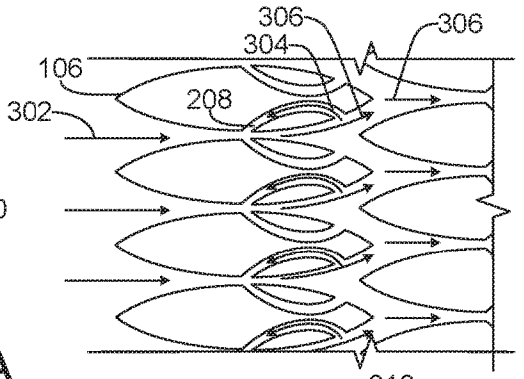
FIGS. 3A-3C illustrate fluid flows at three successive times for the example oscillating fluid flow apparatus of FIGS. 1 and 2.
Figure 3B:
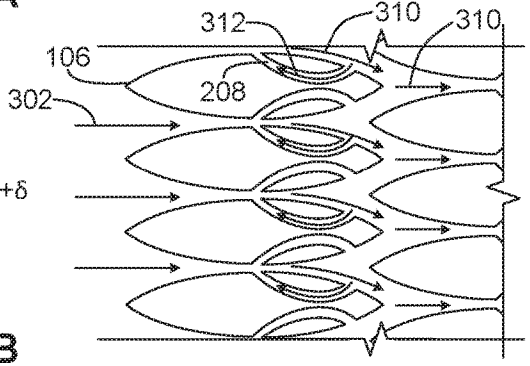
Figure 3C:
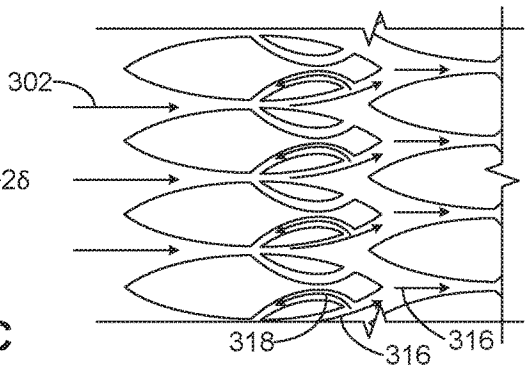

FIGS. 3A-3C illustrate fluid flows at three successive times for the example oscillating fluid flow apparatus 100 of FIGS. 1 and 2. Turning to FIG. 3A, which illustrates fluid flow at a first time, as indicated by $T_0$, a fluid flow 302 is shown moving past a first row of the fins 106. At this time, a portion of the fluid flow 302 moves into the sub-channel 208 on a lower side of the fin 106, as generally indicated by an arrow 304. Another portion of the fluid flow 302 moves generally upward towards another row of the fins 106, as generally indicated by arrows 306.

Turning to FIG. 3B, a portion of the fluid flow 302 moves past the first row of the fins 106 at a second time, as indicated by $T_0+\delta$. However, in contrast to the fluid flow at the time depicted in FIG. 3A, a portion of the fluid flow 302 moves along the aforementioned upper-sub-channel 208, as generally indicated by an arrow 312 while another portion of the fluid flow 302 moves past the fin 106 in a downward direction, as generally indicated by arrows 310, thereby defining a flow pattern at the second time that is different from the fluid flow at the first time. In particular, the flow pattern at the second time has moved in a different direction from the flow pattern at the first time due to disturbances at the first time step resulting from the portion of the fluid flow 302 moving along the direction indicated by the arrow 304.

Turning to FIG. 3C, the fluid flow at a third time, which is denoted by $T_{0+2\delta}$, is shown. As can be seen in the illustrated example of FIG. 3C and as generally indicated by arrows 316 and an arrow 318, the fluid flow 302 has returned to an upward flow pattern similar to that shown in FIG. 3A. In other words, the fluid flow at the third time is similar and/or identical to the fluid flow at the first time and, thus, a cyclical oscillating time-dependent flow pattern (e.g., a periodic flow pattern) is established. The oscillations of the illustrated example may be adjusted based on flow rate, geometry adjustments, and/or spacing adjustments. In some examples, the geometric and/or spacing adjustments between the fins 106 may be varied by mechanically and/or electrically movable elements (e.g., an actuator, an adjustable wall, flap and/or movable/rotatable fins). As a result, the fluid moving past fins 106 has greater circulation past the fins 106, thereby increasing heat flux moving therebetween.

Figure 3D:
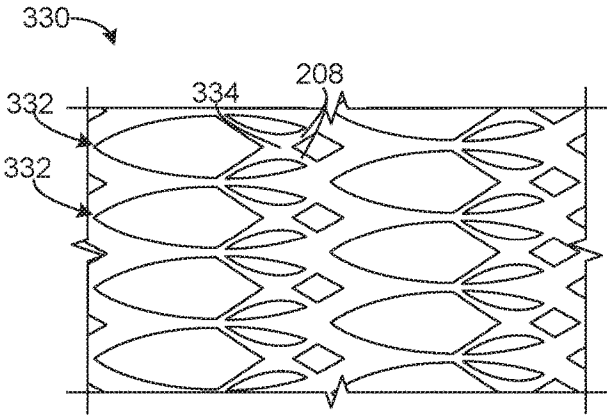
FIGS. 3D-3G depict alternative examples to the tessellated pattern shown in FIGS. 1-3C.

FIGS. 3D-3G depict alternative examples to the tessellated pattern of the fins 106 shown in FIGS. 1-3C. Turning to FIG. 3D, a fin pattern 330 is shown. The fin pattern 330 of the illustrated example includes fins 332, which are similar to the fins 106, but also include a communication opening 334 that fluidly couples the opposing sub-channels 208. In other words, the sub-channels 208 of this example define a mixing area/volume therebetween.

Figure 3E:
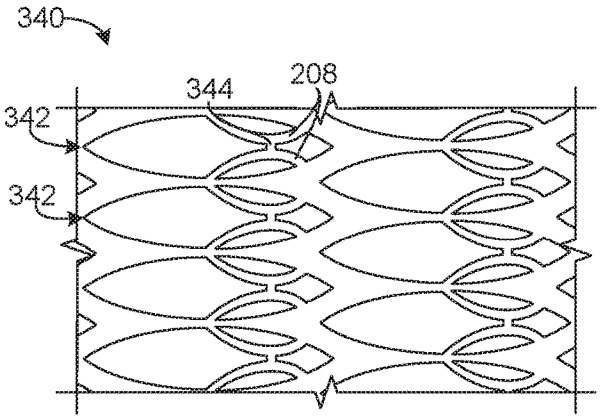

FIG. 3E depicts another example tessellated pattern 340 with fins 342. According to the illustrated example, each of the fins 342 have a relatively small channel 344 to fluidly couple the opposing sub-channels 208 of each of the fins 342. However, in contrast to the example fin pattern 330 of FIG. 3D, the channel is relatively small and does not define a mixing volume between the sub-channels 208.

Figure 3F:
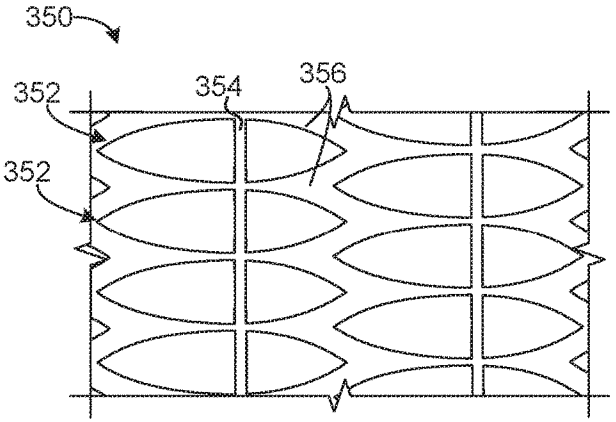

Turning to FIG. 3F, yet another example tessellated pattern 350 is shown. In this example, fins 352 of the tessellated pattern 350 include a channel 354 to fluidly couple adjacent channels 356 surrounding the fins 352. In this example, fluid flow oscillates upward and downward (in the view of FIG. 3F) along the channel 354.

Figure 3G:
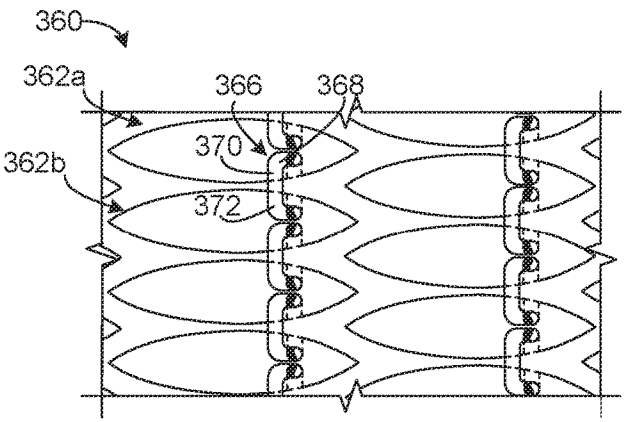

FIG. 3G illustrates an example tessellated pattern 360, which does not include the sub-channels 208 as shown above. Instead, the tessellated pattern 360 of the illustrated example includes fins 362*a*, 326*b* having a three-dimensional sub-channel 366 that extends therebetween into (e.g., into/out of the view shown) a direction of the view of FIG. 3G. In particular, the example sub-channel 366 includes a first portion 368 that extends from the fin 362*a* in a perpendicular direction (e.g., into/out of the view shown) to the general flow moving past the fins 362*a*, 362*b*, a second transverse portion 370 that moves across to the adjacent fin 362*b*, and a third portion 372 that extends into the fin 362*b*. In this example, fluid flow oscillates between the fin 362*a* and the fin 362*b* along the sub-channel 366.

Figure 4:
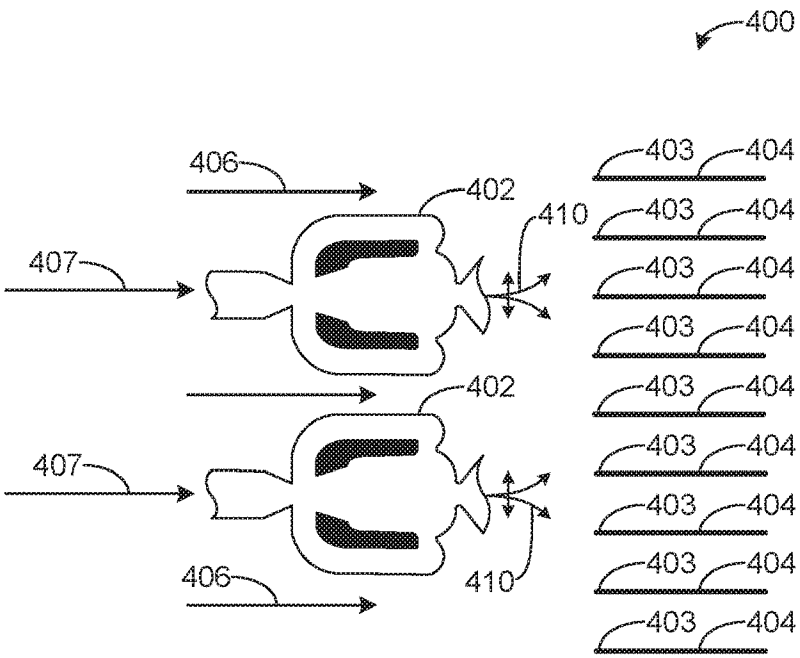
FIG. 4 illustrates an alternate example oscillating fluid flow apparatus in accordance with the teachings of this disclosure.

FIG. 4 illustrates an alternate example oscillating fluid flow apparatus 400 in accordance with the teachings of this disclosure. According to the illustrated example, the oscillating fluid flow apparatus 400 includes a pattern of sweep jets (e.g., fluidic oscillators, a sweep jet array) 402 arranged in a row that is parallel to leading edges 403 of fins (e.g., parallel fins) 404, which are straight (e.g., rectangular). In this example, the sweep jets 402 are microchannel scale flow channel devices that provide an oscillating fluid flow emerging therefrom based on their overall geometric shape (e.g., a combination of chambers and tubes).

To define an oscillating fluid flow past the fins 404, a first portion of a fluid flow 406 moves between adjacent sweep jets 402 while a second portion of the fluid flow 407 moves into the sweep jets 402. The second portion 407 that flows into the sweep jets 402 emerges from the respective sweep jets 402 as an oscillating fluid flow (up and down along the view of FIG. 4), as generally indicated by arrows 410.

In some examples, multiple rows of the sweep jets 402 are disposed relative to the leading edges of the fins 404. For example, a repeating pattern of the sweep jets 402 and the fins 404 (e.g., a repeating pattern of one row of the sweep jets 402 followed by a row of the fins 404) may extend along a direction of the fluid flow 406. In some examples, a pitch of the sweep jets 402 may vary from row to row. Additionally or alternatively, a pitch of the fins 404 may vary from row to row.

Figure 5:
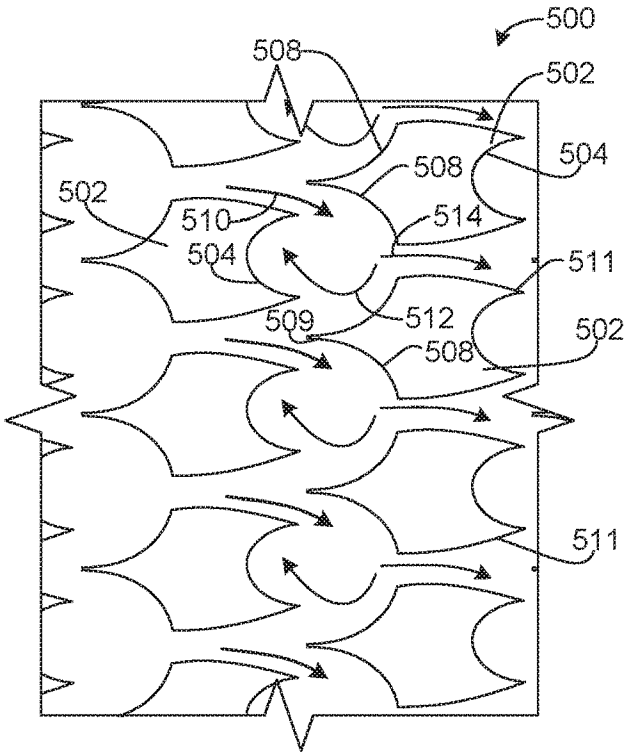
FIG. 5 is yet another alternate example oscillating fluid flow apparatus in accordance with the teachings of this disclosure.

FIG. 5 is yet another alternate example oscillating fluid flow apparatus 500 in accordance with the teachings of this disclosure. The oscillating fluid flow apparatus 500 of the illustrated example includes fins 502 arranged in staggered rows. In this example, the fins 502 are substantially identical (e.g., having identical shapes) between the rows. As can be seen in the illustrated example of FIG. 5, the rows of the fins 502 are staggered/offset (in a vertical direction of the view of FIG. 5) relative to one another (e.g., staggered by half a pitch distance between the fins 502).

To generate an oscillatory motion of a fluid flow moving past the fins 502, the fins 502 include first arcuate surfaces (e.g., an incurvate surface, a scallop cut, an indentation, etc.) 504 as well as second arcuate surfaces 508 in a generally opposing relationship to the arcuate surfaces 504. In particular, the combination of the first and second arcuate surfaces 504, 508 as well as the aforementioned row offset defines a recirculating fluid flow path that produces a fluid flow oscillation. The second arcuate surfaces 508 of the illustrated example define a converging tip 509 at a leading edge of the respective fin 502. Further, the first arcuate surfaces 504 define generally converging (i.e., converging along a general direction of fluid flow) opposing surfaces 511.

As can be seen in the illustrated example of FIG. 5, a portion of the fluid flow moves downward past one of the fins 502, as generally indicated by an arrow 510, which is directed downward in this view. In turn, the combination of the arrangement of the arcuate surfaces 504 along with the vertically offset second arcuate surfaces 508 results in a recirculation fluid flow, as generally indicated by an arrow 512, while some of the fluid flows along a direction indicated by an arrow 514. A resulting instability from this recirculation fluid flow results in oscillations of the fluid flow (e.g., upward and downward in the view of FIG. 5) such that the aforementioned portion of the fluid flow then flows upward (e.g., the direction of flow indicated by the arrow 510 reverses to an upward direction). As a result, these generally vertical oscillations in fluid flow enhance mixing to increase a convective heat transfer from/to the fins 502 (per unit volume of fluid flow moving past the fins 502).

Figure 6:
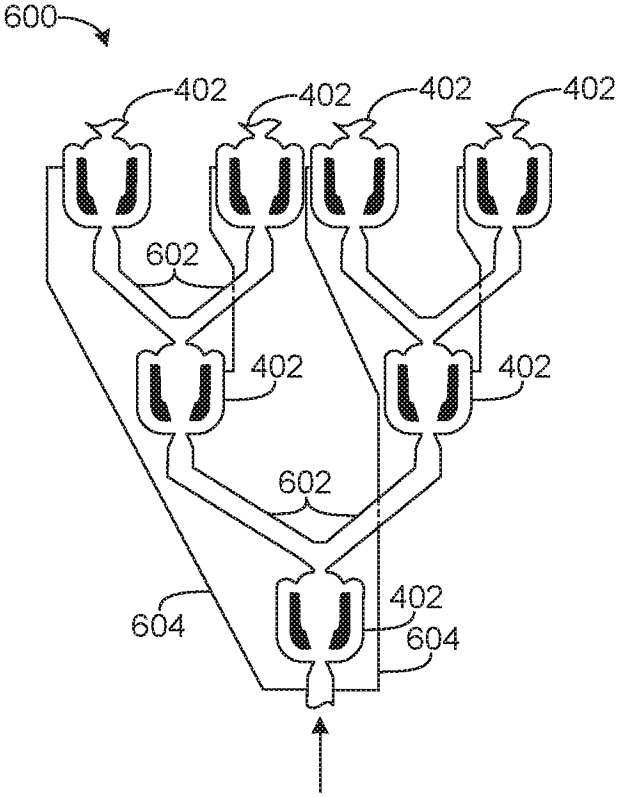
FIG. 6 depicts an example oscillator pattern that may be implemented in the examples disclosed herein.

FIG. 6 depicts an example oscillator pattern (e.g., a branching pattern of sweep jets) 600 that may be implemented in the examples disclosed herein. According to the illustrated example, the oscillator pattern 600 includes the sweep jets 402 arranged in a generally branching pattern. In particular, fluid flows emerging from the example sweep jets 402 are combined via junctions 602 that provide the fluid to the respective sweep jet 402. Further, the example oscillator pattern 600 also includes bypasses 604 that fluidly couple portions of the oscillator pattern 600 by providing a flow path that bypasses at least one stage of the oscillator pattern 600.

The oscillator pattern 600 of the illustrated example may be implemented proximate the inlet 108 of the fluid flow apparatus 100 to mix fluid flow prior to the fluid moving past the fins 106, for example. In other words, the oscillator pattern 600 may be utilized after the inlet 108, but prior to the fins 106. Additionally or alternatively, the oscillator pattern 600 is implemented within (e.g., embedded within) an array of fins (e.g., the fins 106 of the fluid flow apparatus 100) to mix fluid, thereby increasing an amount of surface interaction between the fluid and heat transfer surfaces.

Figure 7:
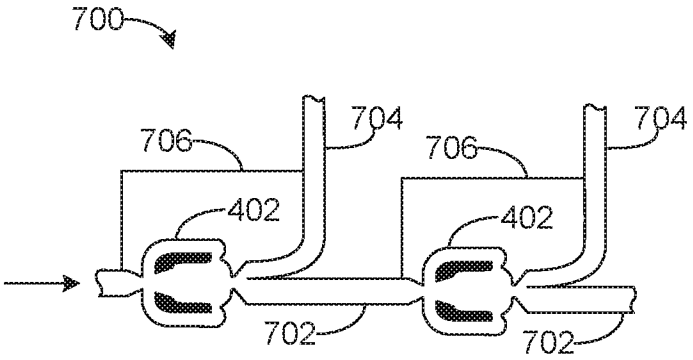
FIG. 7 depicts another example oscillator pattern that may be implemented in the examples disclosed herein.

FIG. 7 depicts another example oscillator pattern 700 that may be implemented in the examples disclosed herein. In this example, the oscillator pattern 700 includes the sweep jets 402 arranged in a sequential pathway from which flow paths 702 and 704 emerge from. In this example, the sweep jets 402 are bypassed by bypasses 706 that are routed to the flow paths 704. This example oscillator pattern 700 allows flow to be effectively mixed in a sequential pattern. Similar to the oscillator pattern 600 of FIG. 6, the example oscillator pattern 700 may be implemented upstream of a fin array (e.g., the fins 106), for example, or embedded within a fin array to further enhance heat transfer (e.g., an amount of heat transferred per unit volume of fluid provided, etc.).

Figure 8:
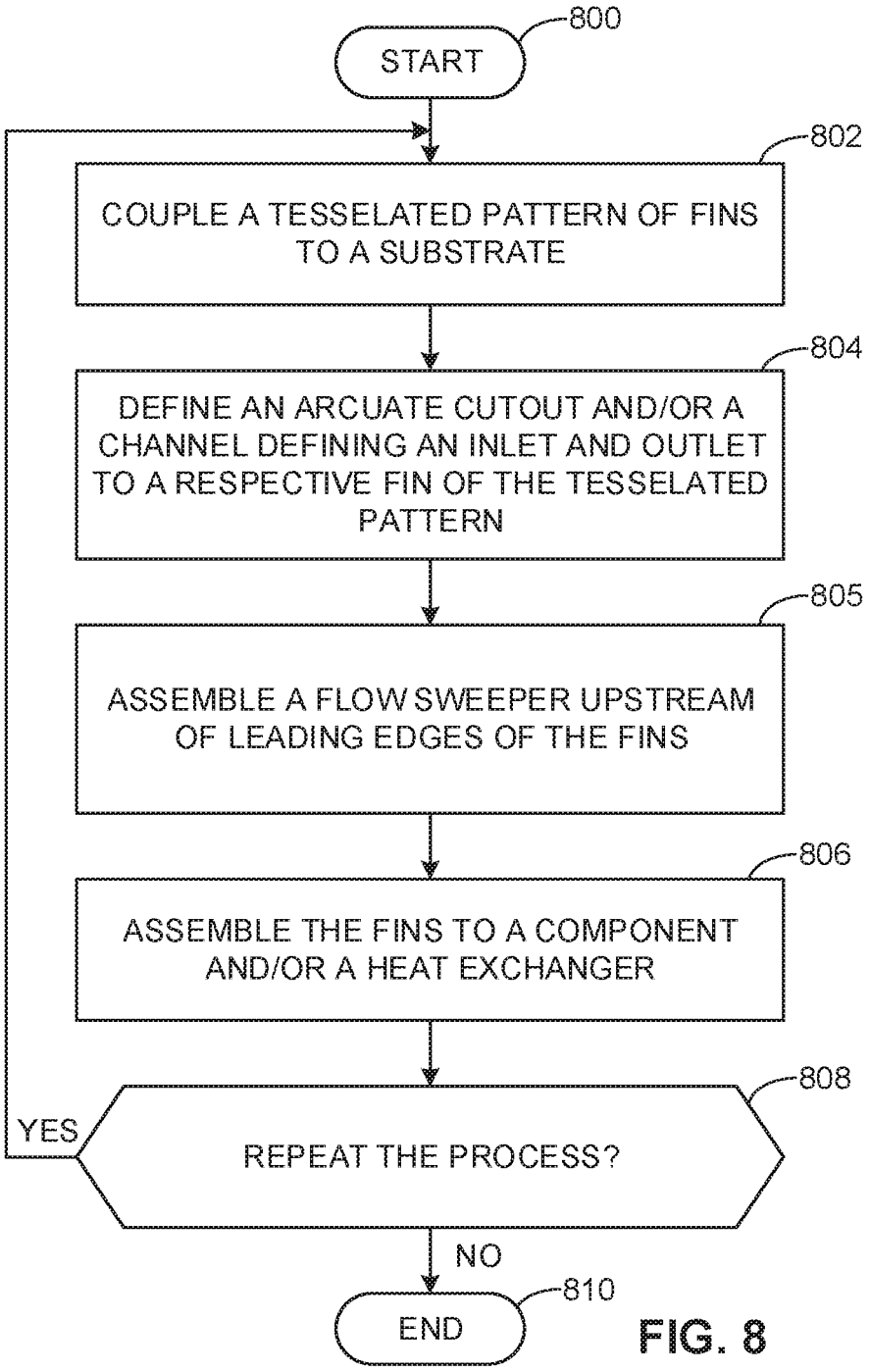
FIG. 8 is a flowchart representative of an example method to assemble the examples disclosed herein.

FIG. 8 is a flowchart representative of an example method to assemble the examples disclosed herein. The example method begins at block 800 where the fin/heat sink array 111 (shown in FIG. 1) is produced to cool an electronics package, such as the substrate 102 (shown in FIG. 1) (block 800). In this example, the heat sink array 111 is produced at a microchannel scale (e.g., on the order of centimeters, millimeters or smaller, microns, a microchannel heat exchanger, etc.).

In this example, a tessellated pattern of fins, such as the fins 106 (shown in FIG. 1) is coupled to a substrate, such as the substrate 102 shown in FIG. 1 (block 802). In particular, fins 106 are produced in a block via a machining or etching process, for example. In some examples, the fins 106 are attached to a substrate 102 and/or any other suitable structure.

According to the illustrated example, next or simultaneously (e.g., contemporaneously) with block 802, an arcuate cutout, such as the arcuate surfaces 504, 508 of FIG. 5, and/or a channel, such as the sub-channel 208 of FIG. 2 that defines the sub-channel inlet 212 and the sub-channel outlet 214, is defined in a respective fin of the tessellated pattern (block 804). In other words, geometric structures that generate an oscillating fluid flow are provided to the fins via an appropriate process such as machining, etching, and/or cutting, etc.

In some examples, an arrangement of flow sweepers, such as the flow sweepers 402 of FIG. 4, are assembled/coupled to a location upstream of the fins 106 (block 805). For example, the flow sweepers 402 may be placed proximate the opening/inlet 108 and/or a leading edge of the fin pattern array 111.

In some examples, the fins 106 and/or the fin pattern array 111 are assembled to a component and/or a heat exchanger, such as the fluid flow apparatus 100 that may be operating as a heat exchanger (block 806). For example, the aforementioned fins 106 may be coupled via a bonding and/or welding process after the arcuate cutout and/or channel has been defined in/provided to the fins 106.

It is then determined whether the process is to be repeated (block 808). For example, this determination may include determining whether additional fin pattern arrays (e.g., the fin pattern array 111) are to be produced. If the process is to be repeated (block 808), control of the process returns to block 802. Otherwise, the process ends (block 810).

Figure 9:
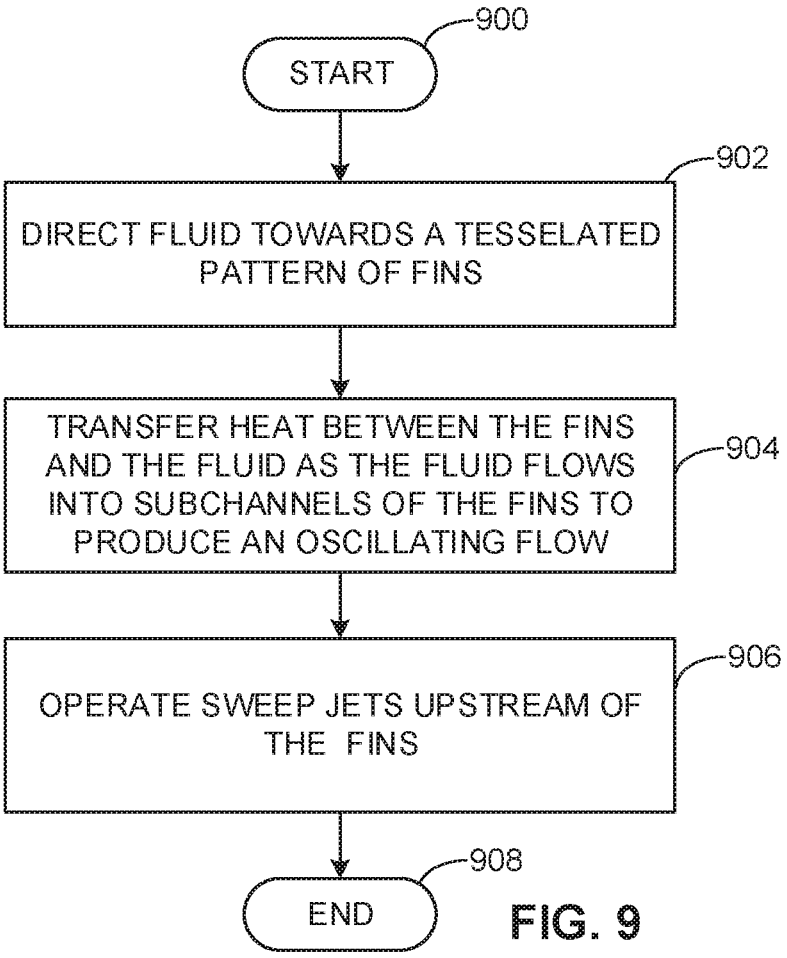
FIG. 9 is a flowchart representative of an example method to operate the examples disclosed herein.

FIG. 9 is a flowchart representative of an example method to operate the examples disclosed herein. In this example, sweep jets, such as the sweep jets 402 (shown in FIG. 4), are used to generate oscillating fluid flow patterns upstream of the fin pattern array 111 (block 900).

A fluid is directed towards a tessellated pattern of fins such as the fin pattern array 111 (block 902). In this example, the fins 106 of the fin pattern array 111 are generally oblong and extend along a direction of fluid flow. In this example, the fins 106 include the sub-channels 208, as described above in connection with FIG. 2.

According to the illustrated example, heat is transferred between the fins and the fluid as the fluid flows into the sub-channels 208 to define an oscillating flow that increases surfaces wetting between the fins 106 and the fluid (block 904)

In some examples, the sweep jets 402 are operated upstream of the fins (block 906). In particular, the sweep jets 402 are arranged/positioned along a row that is upstream of leading edges of the fins 106 when the fins 106 are placed into a fluid flow. In particular, an array (e.g., row(s)) of the sweep jets 402 is placed in front of the leading edges to generate an oscillatory fluid flow past the fins 106 while a portion of the fluid flows around and past the sweep jets 402.

The process then ends (block 908).

From the foregoing, it will be appreciated that the above disclosed methods, apparatus and articles of manufacture enable oscillating fluid flows to increase heat transfer effectiveness and/or efficiency of fins (e.g., watts transferred per volume of material used in cooling) without moving parts. For example, heat transfer through fins is enhanced due to increased local mixing and/or surface wetting.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent. While the examples disclosed herein are shown as having microchannel scales, any appropriate cooling/heating application on any appropriate scale may implement the examples disclosed herein.

What is claimed is:

1. A fluid flow apparatus comprising:

a repeating pattern of fins arranged in rows, wherein fins of each row are separated from one another by channels, the fins having respective sub-channels extending therethrough to facilitate oscillation of fluid moving through the channels, wherein each of the sub-channels defines a sub-channel inlet and a sub-channel outlet of a respective fin of the pattern.

2. The fluid flow apparatus as defined in claim 1, wherein each of the fins has an oblong shape extending along a direction of flow of the fluid.

3. The fluid flow apparatus as defined in claim 1, wherein each of the sub-channel outlets is proximate a middle portion of a respective fin of the pattern.

4. The fluid flow apparatus as defined in claim 1, wherein each of the sub-channel inlets is proximate a trailing edge of a respective fin of the pattern.

5. The fluid flow apparatus as defined in claim 1, wherein adjacent rows of the pattern are staggered relative to one another.

6. The fluid flow apparatus as defined in claim 1, further including a branching pattern of sweep jets upstream of the pattern.

7. The fluid flow apparatus as defined in claim 1, wherein the fins further include an opposing sub-channel on an opposite side of the sub-channel.

8. A method for operating a fluid flow apparatus including a substrate and a repeating pattern of fins separated from one another by channels, the method comprising:

directing a fluid towards the fins, wherein ones of the fins have respective sub-channels extending therethrough to facilitate oscillation of fluid moving through the channels, wherein each of the sub-channels defines a sub-channel inlet and a sub-channel outlet of a respective fin of the pattern; and transferring heat between the fins and the fluid as the fluid flows into the sub-channels to define an oscillating fluid flow that increases surface wetting between the fins and the fluid.

9. The method as defined in claim 8, further comprising discharging the fluid from a fluid outlet opening downstream of the fins.

10. The method as defined in claim 8, further comprising operating a flow sweeper upstream of the fins.

11. Transferring heat between the fluid and a heat generating device, using the method as defined in claim 8.

12. Transferring heat between the fluid and an additional fluid, using the method as defined in claim 8.

13. A fluid flow apparatus comprising:

means for generating a recirculating fluid flow across a tessellated pattern of fins arranged in rows, the means for generating the recirculating flow having fluid flow direction oscillation means.

14. The fluid flow apparatus as defined in claim 13, wherein the tessellated pattern of fins is disposed in a microchannel heat exchanger.

15. The fluid flow apparatus as defined in claim 13, wherein the flow direction oscillation means are disposed between the rows.

* * * * *